US005839462A

United States Patent [19]

Randall

[11] Patent Number: 5,839,462

[45] Date of Patent: Nov. 24, 1998

[54] EXTENSIBLE AND RETRACTABLE CANOPY STRUCTURE FOR VEHICLES AND THE LIKE

[76] Inventor: Paul G. Randall, 1457 W. University Dr. #88, Mesa, Ariz. 85201

[21] Appl. No.: 858,728

[22] Filed: May 19, 1997

[51] Int. Cl.[6] ..... E04H 15/44

[52] U.S. Cl. ..... 135/128; 135/131; 135/151; 135/88.06

[58] Field of Search ..... 135/127, 128, 135/129, 130, 131, 133, 134, 151, 143, 148, 149, 907, 116, 115, 88.06; 52/64, 69, 173.2

[56] References Cited

U.S. PATENT DOCUMENTS

| | | | |
|---|---|---|---|
| 2,571,362 | 10/1951 | Hervey | 135/134 |
| 2,798,501 | 7/1957 | Oliver | 135/134 |
| 3,131,705 | 5/1964 | Marino | 135/131 |
| 3,171,417 | 3/1965 | Stokes | 135/115 X |
| 4,425,929 | 1/1984 | Von Mosshaim | 135/116 X |
| 4,886,083 | 12/1989 | Gamache | 135/133 X |
| 5,238,288 | 8/1993 | Chandler | 135/129 X |
| 5,240,021 | 8/1993 | Snodgrass | 135/96 |
| 5,579,796 | 12/1996 | Mallo et al. | 135/88.06 |

*Primary Examiner*—Carl D. Friedman
*Assistant Examiner*—Winnie S. Yip
*Attorney, Agent, or Firm*—John D. Lister

[57] ABSTRACT

A canopy structure includes a support frame with a plurality of extensible and retractable canopy support sections. Each of the canopy support sections includes a pair of upper transverse support members and two pairs of side support members. Each pair of side support members have lower portions which are pivotally secured to each other and upper portions which are rigidly secured to ends of the upper transverse support members whereby in a retracted position the side support members extend substantially vertical and in an extended position the side support members extend at an acute angle to each other with the upper portions of the side support members spaced apart. The canopy support frame also includes end frames with upper transverse support members secured to the transverse support members of adjacent canopy support sections and generally vertically extending side support members connected to adjacent side support members of adjacent canopy support sections by means for retaining the side support members of the end frames and the adjacent support sections in a fixed, spaced relationship when the canopy structure is extended to maintain the canopy structure in an extended mode. A cover, secured to the canopy support sections and end frames, connects the upper transverse support members of adjacent canopy support sections.

16 Claims, 6 Drawing Sheets

EXTENSIBLE AND RETRACTABLE CANOPY STRUCTURE FOR VEHICLES AND THE LIKE

BACKGROUND OF THE INVENTION

The present invention relates to a canopy structure and, in particular, to an extensible and retractable canopy structure, such as a shade canopy, especially suited for housing and protecting vehicles, boats, trailers and other relatively large, typically mobile, objects from the elements.

For various reasons, owners of vehicles, boats, jet skis, snow mobiles, trailers, and other relatively large objects have a need, on either a temporary or semipermanent basis, to shade, house, store, protect from the elements and/or, for aesthetic reasons, shield from view a vehicle, boat, jet ski, snow mobile, trailer, or other large object which is typically mobile. Frequently, due to the number of vehicles in a family, the need to store other things in the garage, or other similar circumstances, the owner has no permanent place, such as the garage, to house the vehicle, boat, jet ski, snow mobile, trailer, or other relatively large object. Faced with this situation, the owner typically stores the vehicle, boat, jet ski, snow mobile, trailer, or other relatively large object: at a rental storage facility which is both expensive and inconvenient; outside where it is exposed to the elements and can be viewed by his/her neighbors; or erects a temporary shelter of some sort that may be awkward to use, unstable, incapable of providing the necessary protection, and an eye sore to his/her neighbors and the community.

Accordingly, there has been a need to provide a relatively inexpensive, yet highly efficient and effective temporary or semipermanent canopy structure for use in shading, housing, sheltering and protecting vehicles, boats, jet skis, snow mobiles, trailers and other relatively large, typically mobile, objects under such circumstances. There has also been a need to provide such a shelter that: is portable; is relatively light weight; is easy to erect and install; is easy to retract or collapse for storage and extend for use; is sturdy, strong and stable in its extended mode; provides color flexibility; provides privacy; and provides easy ingress and egress through its entrance(s) for the object being stored.

SUMMARY OF THE INVENTION

The extensible and retractable canopy structure of the present invention is portable and relatively light weight; is easy to erect, install, extend and retract; is sturdy and stable in its extended mode; has color flexibility; provides privacy; provides easy ingress and egress through its entrance(s); and, while suited for other uses, is particularly suited for housing and protecting vehicles and other relatively large, typically mobile objects, from the elements. The canopy structure of the present invention includes a support frame with a plurality of extensible and retractable canopy support sections. Each of the canopy support sections includes a pair of upper transverse support members and pairs of side support members which extend in generally vertical planes along each side of the canopy structure. Each pair of side support members have lower portions which are pivotally secured to each other and upper portions which are rigidly secured to ends of the upper transverse support members whereby when the canopy structure is in a retracted position the side support members extend substantially vertical and when the canopy structure is in an extended position the side support members extend at an acute angle to each other with the upper portions of the side support members spaced apart.

The canopy support frame also includes end frames with upper transverse support members secured to the transverse support members of adjacent canopy support sections and generally vertically extending side support members connected to adjacent side support members of adjacent canopy support sections by means for retaining the side support members of the end frames and adjacent support sections in a fixed, spaced relationship when the canopy structure is extended to maintain the canopy structure in an extended mode. Preferably, the retaining means includes an arm extending between each of side support members of the canopy end frames and the adjacent side support member of one of the end canopy support sections. Each of the arms is pivotally mounted to one of the adjacent side support members and slidably secured to the other of the adjacent side support members and a removable retainer pin holds the arm in position to maintain the adjacent side support members in the fixed, spaced apart relationship when the canopy structure is extended. Preferably, a coil spring or other biasing means is connected to the arm to facilitate the movement of the arm from a retracted position to the extended position.

A canopy cover, secured to the canopy support sections and the canopy end frames, connects the upper transverse support members of adjacent canopy support sections. Preferably, the canopy cover has side portions which enclose the sides of the canopy structure and one or both ends of the canopy structure are provided with end covers that permit ingress and egress from the canopy structure without raising the end cover. In one embodiment, the end cover includes a plurality of overlapping, vertically extending, flexible strips depending from a transverse support member of the canopy support frame. Where a shade screen material is used for the canopy cover, a second moisture proof cover can be included with the canopy structure to further protect the contents of the canopy structure, e.g. a vehicle, from the elements.

The canopy structure can be free standing and/or provided with means to fasten one end of the canopy structure to a structure, such as a garage or building. Preferably, the side support members are extensible and retractable to adjust the height of the canopy structure and the side support members are provided with wheels or other means to facilitate the extension or retraction of the canopy structure.

enclosing an entrance to the canopy structure and an optional moisture proof cover overlaying the preferred shade screen cover.

Figure 6:
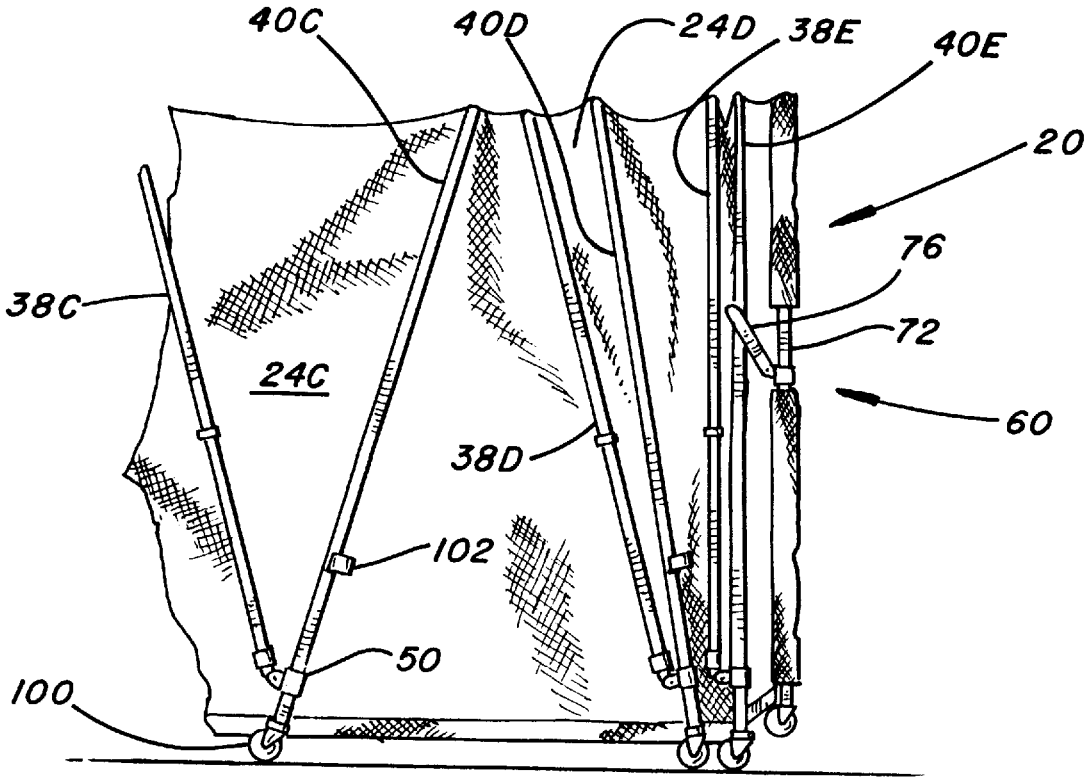

FIG. 6 is a partial side elevation view of the canopy structure showing an end frame and an adjacent canopy support section in a retracted mode.

DESCRIPTION OF THE PREFERRED EMBODIMENTS

Figure 4:
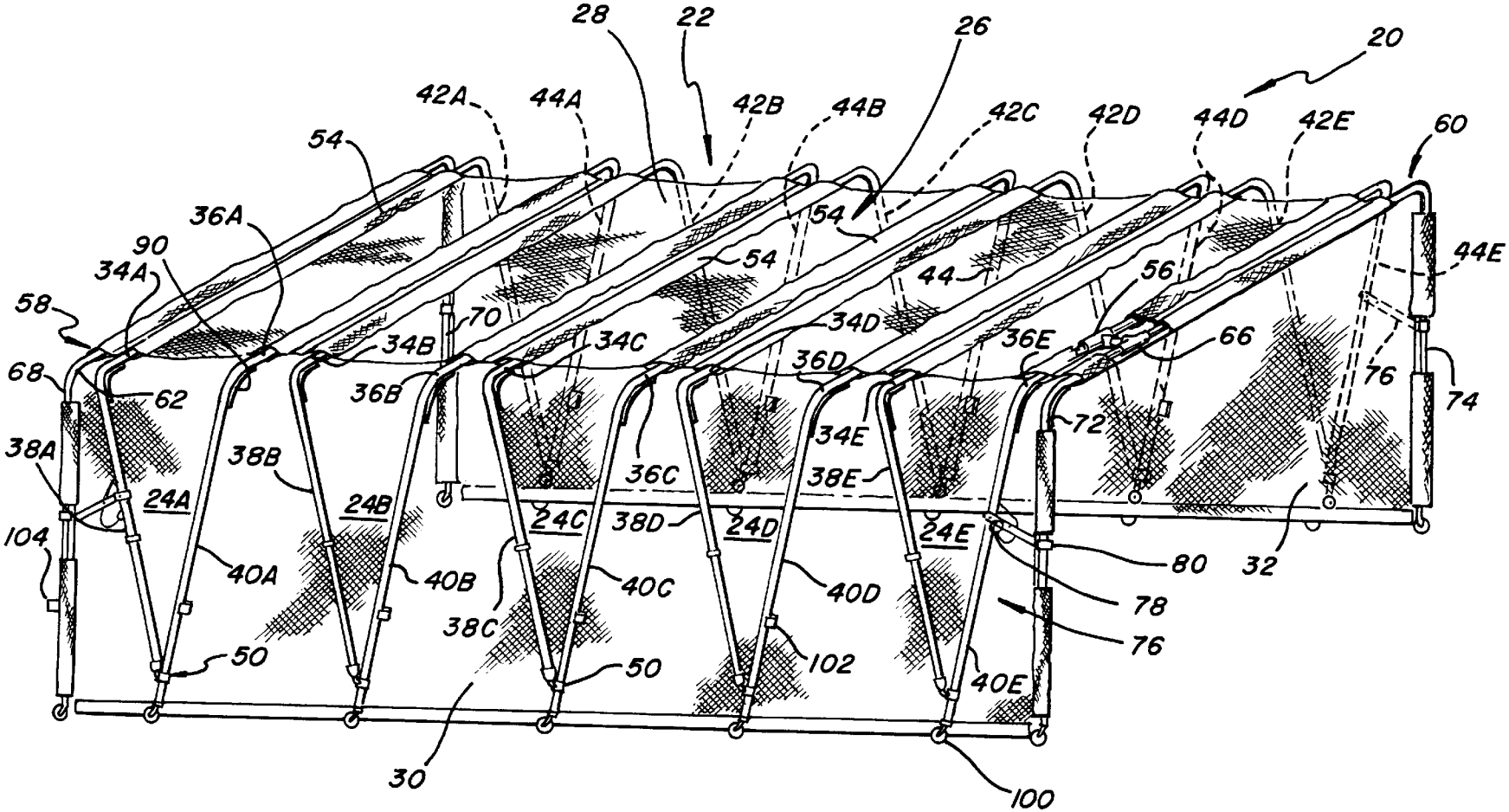
FIG. 4 is a perspective view, with portions of the canopy cover broken away to better show the canopy support frame, of the canopy structure of the present invention.

As best shown in FIG. 4, the canopy structure of the present invention 20 includes a support frame 22 with a plurality of extensible and retractable canopy support sections 24A, 24B, 24C, 24D and 24E and a canopy cover 26 with a roof portion 28 and, preferably, side portions 30 and 32. While including at least two extensible and retractable canopy support sections, and preferably more than two canopy support sections, the number of canopy support sections is not restricted to the number shown in FIG. 4.

Each of the canopy support sections 24A–E includes a pair of upper transverse support members 34A, 36A; 34B, 36B; 34C, 36C; 34D, 36D and 34E, 36E which extend generally perpendicular to a longitudinal centerline of the canopy structure 20 and two pairs of side support members 38A, 40A; 38B, 40B; 38c, 40C; 38D, 40D, and 38E, 40E on a first side of the canopy structure 20 and 42A, 44A; 42B, 44B; 42C, 44C; 42D, 44D; and 42E, 44E on a second side of the canopy structure 20. While the pairs of side support members 38A–E, 40A–E, 42A–E and 44A–E and the sides of the canopy structure may extend inwardly at an angle from the base of the canopy structure 20, the pairs of side support members and the sides of the canopy structure 20 preferably extend in generally vertical planes along each side of the canopy structure 20. Preferably, the side support members 38A–E, 40A–E, 42A–E and 44A–E, are each adjustable in length and include upper and lower telescoping sections which can be locked in place by collars 46 and 48 shown in FIG. 3 or other conventional means to retain the side support members at a desired or selected length.

Figure 3:
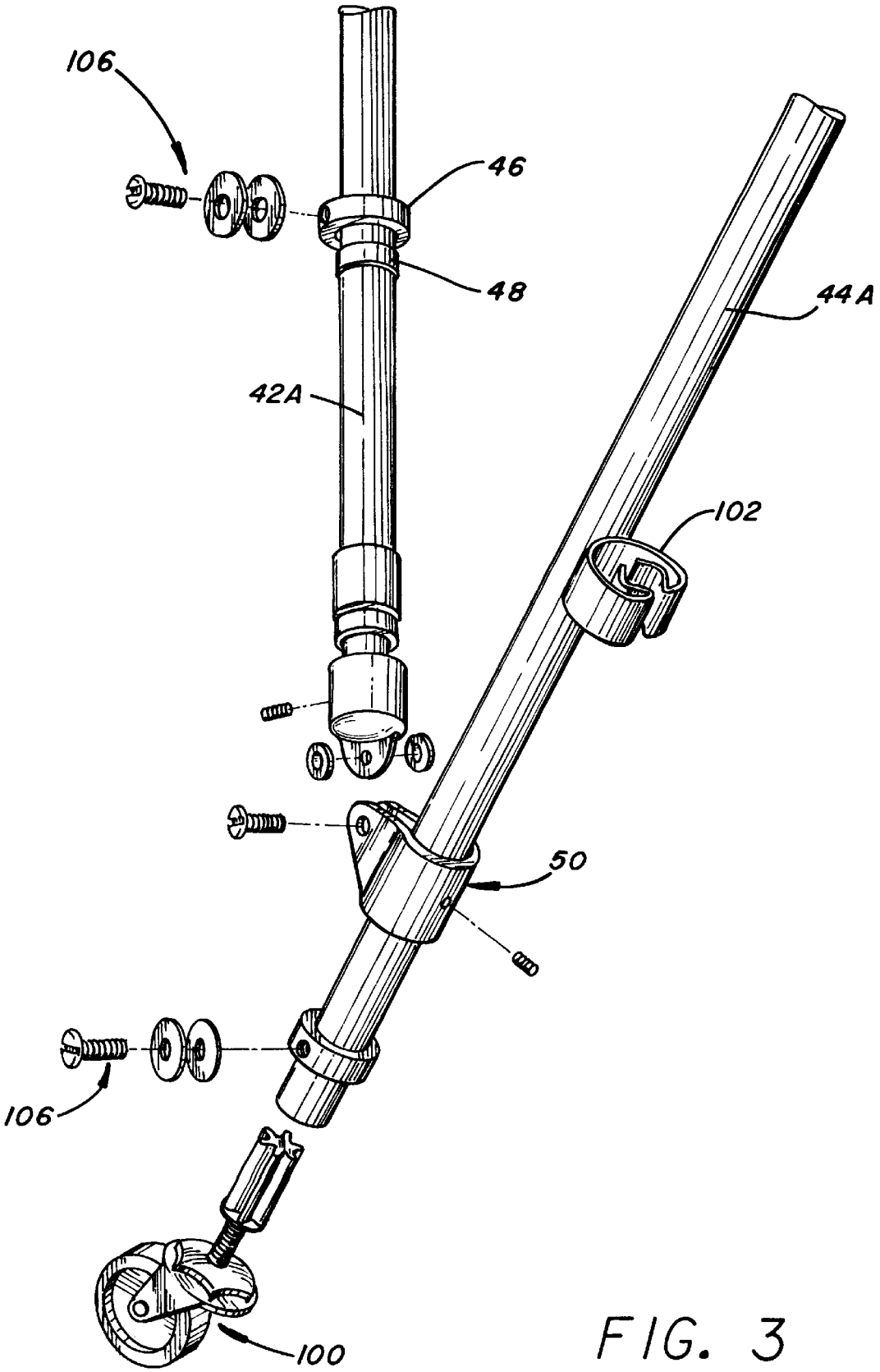
FIG. 3 is an exploded, perspective view of the lower portions of the side support members of a canopy support section.
Figure 5:
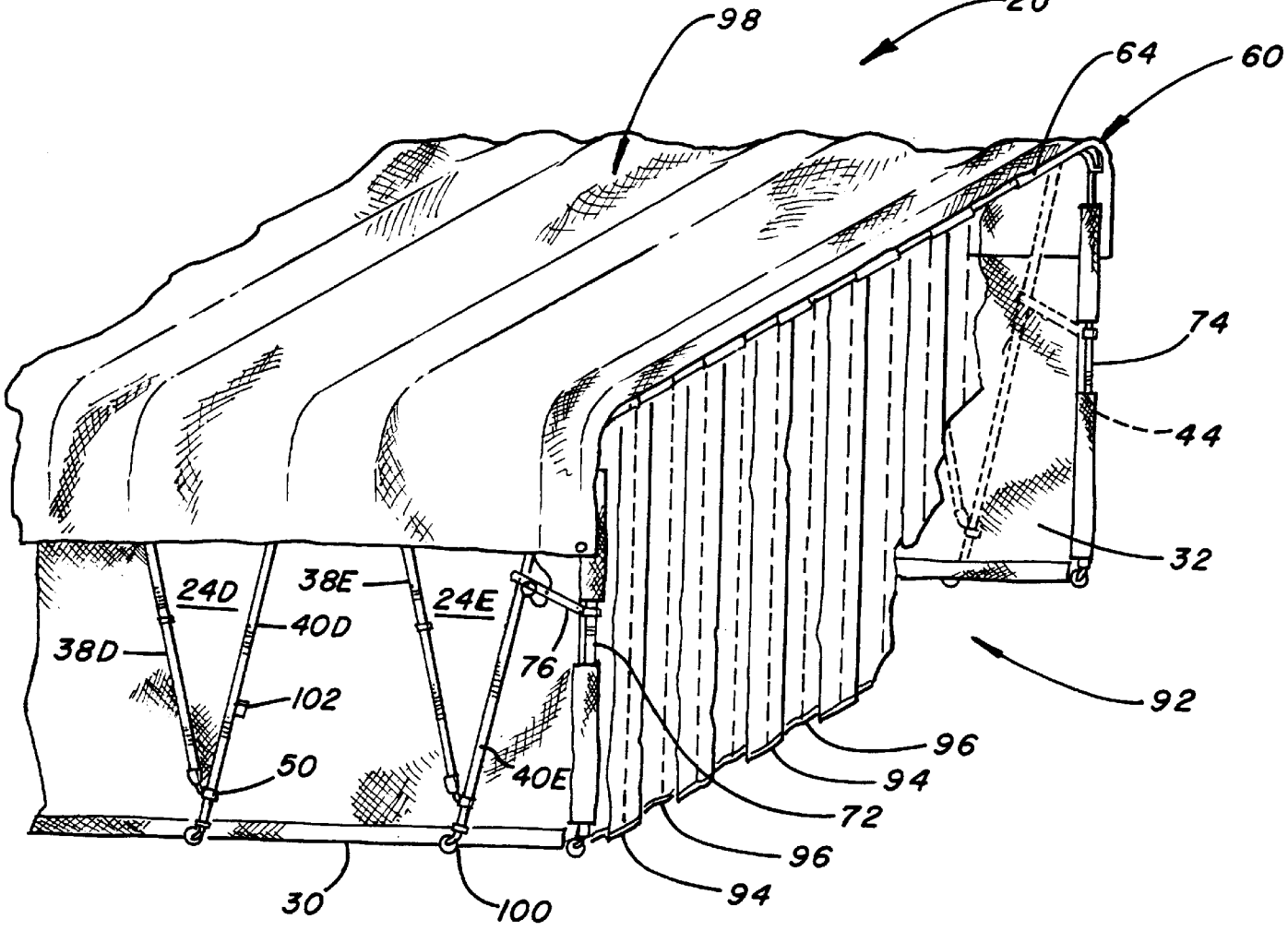
FIG. 5 is a partial perspective view of one end of the canopy structure with an end cover (partially broken away)

As shown in FIGS. 4, 5, and 6 and in detail in FIG. 3, each pair of the side support members 38A–E, 40A–E and 42A–E, 44A–E have lower portions which are pivotally secured to each other. While other means may be used to pivotally secure the pairs of side support members together, in one preferred embodiment, shown in FIG. 3, the lower ends of each of the side support members 38A–E and 42A–E are pivotally secured to the lower portions of each of the side support members 40A–E and 44A–E by foldable jaw slides 50.

Figures 1, 1A:
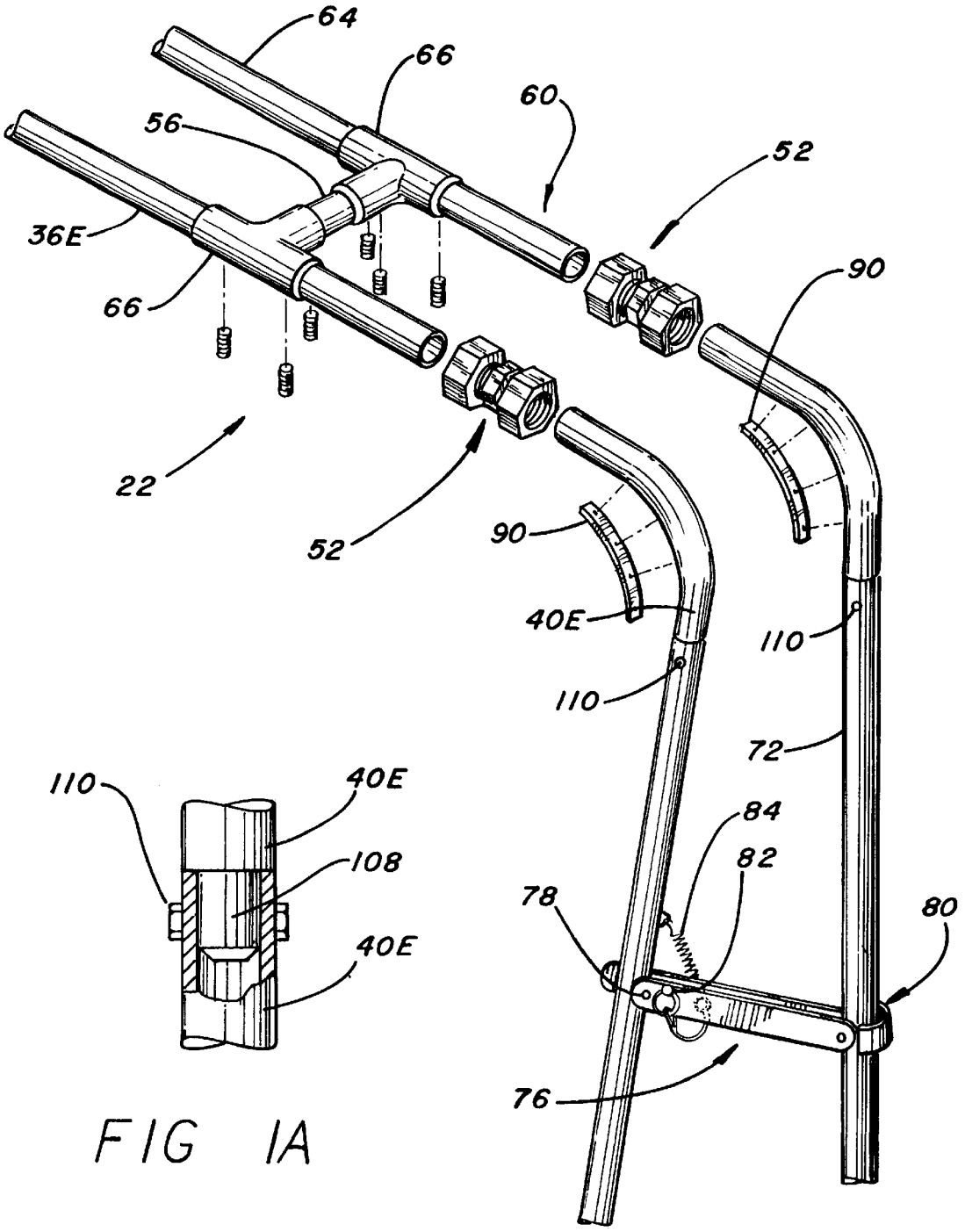
FIG. 1 is an exploded, partial perspective view of a portion of the extensible and retractable canopy support frame of the present invention showing the connection between an end frame and an adjacent canopy support section.
FIG. 1A is an enlarged view of the circled portion of FIG. 1, with a portion broken away, to show in detail a connection between upper and lower portions of the side support members that permits these members to be separated.

As shown in FIG. 1, the upper portions of the side support members 38A–E, 40A–E and 42A–E, 44A–E are rigidly secured to ends of the upper transverse support members 34A–E and 36A–E by conventional tubular coupling members 52. The upper transverse support members 34A–E and 36A–E pass through sleeves 54 of the canopy cover 26 and are preferably joined to the transverse support members of adjacent canopy support sections 24 A–E by means of the canopy cover 26. In addition to the canopy cover 26, the transverse support members of the adjacent canopy support sections 24A–E may also be joined by opposed "T" connectors 56 of the type shown in FIG. 1. With this construction, when the canopy structure 20 is in a retracted mode or position the side support members extend substantially vertical as shown in FIG. 6 and when the canopy structure 20 is in an extended mode or position the side support members extend at an acute angle to each other with the upper portions of the side support members spaced apart as shown in FIGS. 4, 5 and 6.

As best shown in FIGS. 1, 4, 5 and 6, the canopy support frame 22 also includes end frames 58 and 60 with upper transverse support members 62 and 64 which are secured to the transverse support members 34A and 36E of adjacent canopy support sections 24A and 24E by opposed double "T" connectors 56. The end frame transverse support members 62 and 64 and/or the transverse support members 34A and 36E of the adjacent canopy support sections 24A and 24E are rotatably received within the sleeves 66 of the opposed double "T" connectors to permit pivotal movement of the end frames 58 and 60 relative to the adjacent canopy support sections 24A and 24E when the canopy structure 20 is being extended or retracted.

Each end frame 58 and 60 also includes generally vertically extending side support members 68, 70 and 72, 74 which are rigidly connected to the transverse support members 62 and 64. The side support members 68, 70 and 72, 74 are also connected to the adjacent side support members 38A, 42A and 40E, 44E of the adjacent canopy support sections 24A and 24E, respectively, by means for retaining the side support members of the end frames and adjacent support sections in a fixed, spaced relationship when the canopy structure is extended to maintain the canopy structure 20 in an extended mode.

Figure 2:
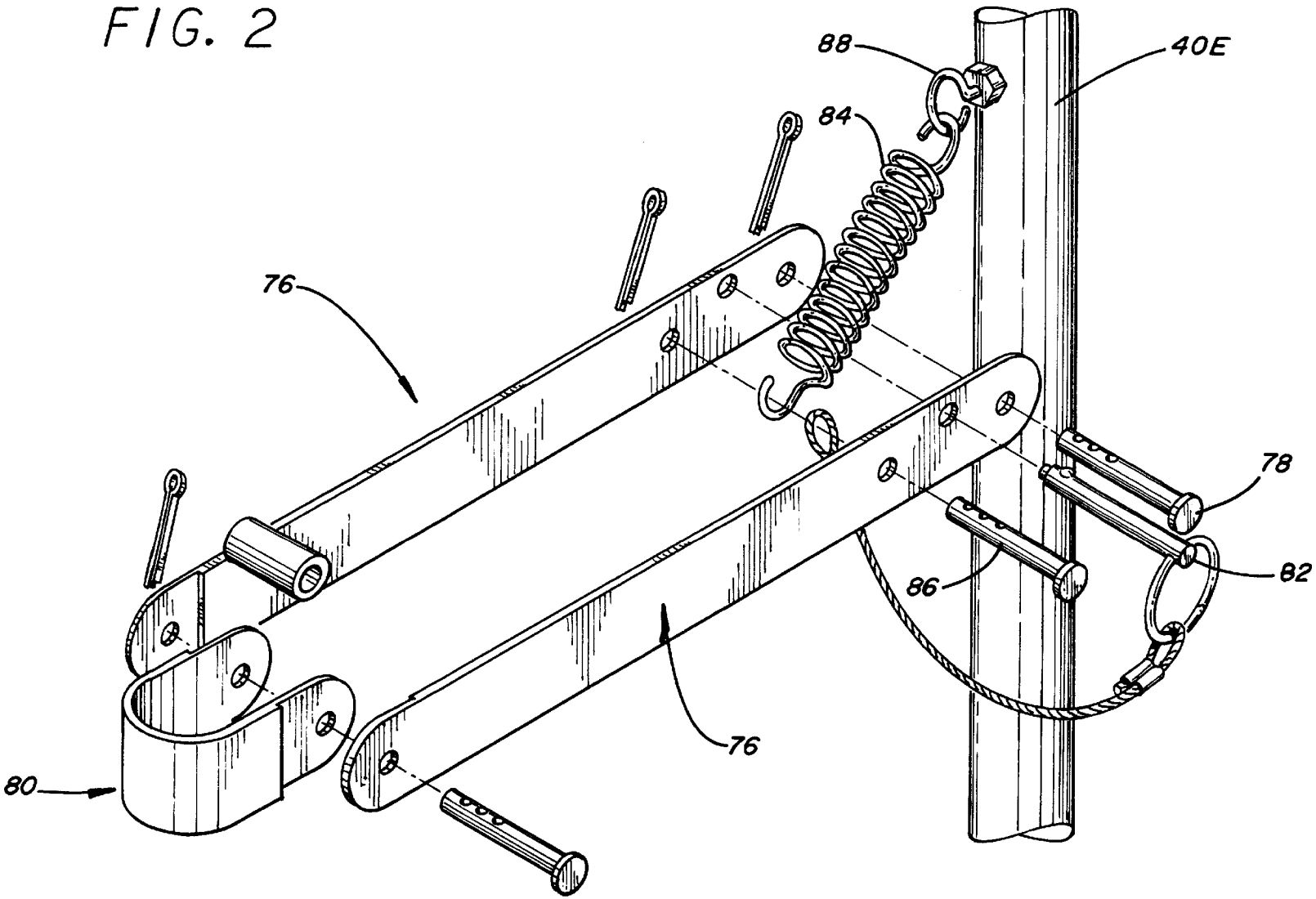
FIG. 2 is an exploded, perspective view of a preferred retaining assembly for retaining the adjacent side support members of the end frames and end support sections in a fixed, spaced relationship when the canopy structure is extended.

Preferably, the retaining means between each side support member of the end frames 58 and 60 and the adjacent side support members of canopy support sections 24A and 24E includes, as best shown in FIG. 2, a rigid arm assembly 76 extending between each side support member of the canopy end frames and the adjacent side support member of the adjacent canopy support section. As shown, in FIGS. 1, 2, 4, 5 and 6, each of the arm assemblies 76 is pivotally secured to one of the adjacent side support members, e.g. secured to side support member 40E in FIGS. 1 and 2, by a pin 78 passing through the arm assembly 76 and the support member 40E, and slidably secured to the other of the adjacent side support members, e.g. secured to side support member 72 in FIGS. 1 and 2 by a "U" shaped sleeve, bushing and pin assembly 80 which slides up and down the side support member 72. A removable retainer pin 82 which passes through the arm assembly 76 and rests against the side support member 40E holds the arm assembly 76 in a fixed position, once the canopy structure 20 has been extended into its fully extended mode, to maintain the adjacent side support members in their fixed, spaced apart relationship and the canopy structure in its fully extended mode once the canopy structure 20 has been extended.

Preferably, a coil spring 84 or other biasing means is connected to the arm assembly 76 at one end by a pin 86 or other means and the side support member 40E at a location above the pivot pin 78 at the other end by an eye bolt 88 or other means to facilitate the movement of the arm assembly 76 from a retracted position as shown in FIG. 6 to the extended position shown in FIGS. 1, 4 and 5. While the arm assembly 76 has been described only in connection with the adjacent side frame members 40E and 72, it is to be understood that the arm assemblies 76 between adjacent side support members 38A, 68; 42A, 70 and 44E, 74; function in the same way.

As shown in FIG.4, the canopy cover 26 is secured to the canopy support sections and end frames of the canopy support frame 22 and connects the upper transverse support members of the adjacent canopy support sections 24A–E. Preferably, as discussed above, in addition to the roof portion 28, the canopy cover 26 has side portions 30 and 32 which enclose the sides of the canopy structure 20. As shown in FIG. 4 and discussed above, the roof portion 28 of the canopy cover 26 is secured to the transverse support members by securement means, such as sleeves 54 which receive the transverse support members. As shown in FIGS. 1 and 4, the canopy cover 26 is also secured to the inside radii of the side support members, preferably by strips 90, eg. made of rubber or metal, and screws which pass through the strips and canopy cover into the side support members. As shown in FIG. 3, mid and bottom portions of the side portions 30 and 32 of the canopy cover 26 can be secured to the side support members 38A–E, 40A–E, 42A–E, 44A–E, and 68–74 by screw and washer assemblies 106 which pass through the canopy cover 26 and are threaded into the side support members. Preferably, the canopy cover 26 is held between the washers of the assemblies 106. While the preferred means for securing the canopy cover to the canopy support frame 22 is shown, other conventional fastening means can be used to secure the canopy cover 26 to the canopy support frame 22.

In addition, to the canopy cover 26, preferably, one or both ends of the canopy structure 20 are provided with an end cover 92 that permit easy ingress and egress from the canopy structure 20 without the need to raise the end cover. As shown in FIG. 5, in one embodiment, each end cover 92 includes a plurality of relatively narrow (e.g. 4 to 8 inches), overlapping, vertically extending, inner and outer flexible strips 94 and 96 respectively that are secured to (e.g. by sleeves at their upper ends that receive the transverse support member) and depend from the end frame transverse support member of the canopy support frame 22. As shown, the cover strips 94 and 96 preferably extend to the ground.

While the canopy cover 26 can be made of various materials, preferably, the canopy cover is made from a shade screen material such as TEXTILENE 80 shade screen material sold by Twitchell or other woven vinyl-covered fabrics made of polyester or other strong yarns that can block up to 80% or more of the suns rays. These shade screen materials are made in a variety of colors and the color of the material used for a particular canopy structure can be selected for aesthetic or other reasons. Where a shade screen material is used for the cover, a second moisture proof cover 98, shown in FIG. 5 and made of vinyl, rubber, treated canvas, or some other commercially available waterproof material, can be included as part of the canopy structure to further protect the contents of the canopy structure 20, e.g. a vehicle, from the elements. The moisture proof cover 98 can be secured to the shade screen material by VELCRO fastening means, tie downs or similar securing means.

The canopy structure 20 can be free standing and/or provided with means, such as brackets 104, to be bolted to one of the end frames 58 or 60 and a garage, building, fence or other structure, to fasten one end of the canopy structure to a fixed structure such as a garage, building or fence. As mentioned above, preferably, the side support members are extensible and retractable to permit the height of the canopy structure 20 to be adjusted, e.g. to accommodate vehicles or objects of different heights, and the side support members are provided with wheels 100 or other means to facilitate the extension or retraction of the canopy support sections 24A–E. In addition, as shown in FIGS. 3, 4, 5 and 6, clamps 102 can be provided on the side support members to secure adjacent side support members together and hold the canopy structure 20 in its retracted position for storage or shipment.

It is to be understood that the dimensions of the canopy structure 20 can be selected to suit the application. However, for storing or housing vehicles and the like, the height of the canopy structure is preferably sufficient to easily clear the roof of the vehicle; the length of the canopy structure is sufficient to clear both ends of the vehicle; and the width of the canopy structure is preferably sufficient to permit the doors of the vehicle to be opened so that the vehicle can be easily entered or exited while within the canopy structure 20. Of course the unique end cover or covers 92 permit a vehicle to be driven into or out of the canopy structure 20 without having to get out of the vehicle to raise or lower the end cover 92. It is also contemplated that the canopy structure can be made wide enough and/or long enough to house two or more vehicles side by side and/or in line with room to enter and exit the vehicles within the canopy structure 20.

In one embodiment of the invention, each of the side support members 38A–E, 40A–E, 42A–E, 44A–E and 68–74 can be made to separate at or, preferably, adjacent and immediately below their curved upper ends as best shown in FIGS. 1 and 1A. As shown, side support member 40E is formed in two sections. One section has an extension 108 which is slidably received within the end the second section. Once the extension 108 is inserted into the end of the second section, a bolt and nut assembly 110 or similar conventional fastening means is passed through aligned holes in the extension 108 and the end of the second section to rigidly secure the sections together. This structure permits the canopy structure 20 to be shipped or stored in three sections, i.e. a roof section and two side sections. To place the canopy structure of this embodiment in use, the roof section is secured to the side sections through the extensions 108 and bolt and nut assemblies 110 of each of the side support members and the canopy structure is then erected and extended for use. If desired, the side support members do not have to be made separable at or adjacent their curved portions as shown in this embodiment.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. An extensible and retractable canopy structure for vehicles and the like; the canopy structure having a longitudinal centerline and being extensible and retractable in the direction of the longitudinal centerline comprising:

a canopy support frame (22) comprising a plurality of extensible and retractable canopy support sections (24A–24E) including first and second end canopy support sections (24A and 24E); each of the canopy support sections including a pair of upper transverse support members (34A–34E and 36A–36E) extending generally perpendicular to the longitudinal centerline of the canopy structure; each of the canopy support sections (24A–24) having first and second pairs of side support members (38A–38E, 40A–40E and 42A–42E, 44A–44E which extend in generally vertical planes along each side of the canopy structure; the side members of each of the pairs of side support members having lower portions pivotally secured to each other and upper portions rigidly secured to ends of the upper transverse support members of (34A–34E and 36A–36E of the canopy support section whereby in a retracted position the side support members of each canopy support section extend substantially vertical and in an extended position the side support members of each canopy support section extend at an acute angle to each other with the upper portions of the side support members spaced apart;

the canopy support frame (22) including first and second canopy end frames (58) and (60), each including an upper transverse support member (62) and (64) and first and second generally vertically extending side support members; (68, 70) and (72, 74);

means (56, 60) securing one of the upper transverse support members (34A and 36E) of each of the end canopy support sections (24A and 24E) to the adjacent transverse support member (62 and 64) of one of canopy end frames (58 and 60);

means (76) for retaining the side support members of the canopy end frames (68, 70 and 72, 74) and adjacent side support members (38A, 42A and 40E and 44E) of the end canopy support sections (24A and 24E) in a fixed, spaced relationship when the canopy structure is extended to maintain the canopy structure in an extended mode;

a canopy cover (26) secured to the canopy support sections (24A–24E) and the canopy end frames (58 and 60); the canopy cover including a roof portion (28) and side portions (30 and 32) enclosing sides of the canopy structure; and the upper transverse support members of each of the canopy support sections being secured closed to the upper transverse support members of adjacent canopy support sections by the canopy cover; and the canopy structure having an entrance at a first end of the canopy structure with a height and a width adapted to the greater than a vehicle to be housed within the canopy structure; and canopy end cover means (92) for providing an end covering for the entrance to the canopy structure and permitting ingress or egress through the entrance of the canopy structure by passing through the canopy end cover means; and the canopy structure having an inside height, an inside width and an inside length adapted to be greater than that of a vehicle to be housed within the canopy structure whereby the vehicle can be housed within the canopy structure and a vehicle door of the vehicle housed within the canopy structure can be opened within the canopy structure to permit the vehicle to be entered or exited through the vehicle door.

2. The extensible and retractable canopy structure according to claim 1, including; means (104) for securing one of the canopy end frames (58) to a structure.

3. The extensible and retractable canopy structure according to claim 1, wherein: the canopy end cover means (92) comprises a series of overlapping, vertically extending, flexible strips (94 and 96) depending from the canopy support frame.

4. The extensible and retractable canopy structure according to claim 3, wherein: the canopy support frame (22) is free standing and including a second canopy end cover means (92) at a second end of the canopy structure.

5. The extensible and retractable canopy structure according to claim 1, wherein: the canopy cover (26) is a solar screen material.

6. The extensible and retractable canopy structure according to claim 5, wherein: the canopy cover (26) is secured to the transverse support members (34A–34E and 36A–36E) by means of sleeves (54) which receive the transverse support members and to inner sides of the upper portions of side support members (38A–38E, 40A–40E and 42A–42E, 44A–44E) by retainer strips (90).

7. The extensible and retractable canopy structure according to claim 1, wherein: the retaining means (76) comprises an arm extending between each of side support members of the canopy end frames (58 and 60) and the adjacent side support member of one of the end canopy support sections (24A and 24E); each of the arms (76) being pivotally mounted to one of the adjacent side support members and slidably secured to the other of the adjacent side support members; and a removable retainer pin (82) for holding the arm (76) in position to maintain the adjacent side support members in the fixed, spaced apart relationship when the canopy structure is extended.

8. The extensible and retractable canopy structure according to claim 7, including: a biasing means (84) to facilitate the movement of the arm (76) from a retracted position to the extended position.

9. The extensible and retractable canopy structure according to claim 7, wherein: the retaining means (56, 60) securing one of the upper transverse support members (34A and 36E) of each of the end canopy support sections (24A and 24E) to the adjacent upper transverse support member (62 and 64) of one of canopy end frames (58 and 60) is pivotally mounted on the transverse support member of the adjacent canopy end frame to permit the canopy end frame to be pivoted between extended and collapsed positions.

10. The extensible and retractable canopy structure according to claim 1, wherein: the side support members (38A–38E, 40A–40E, 42E, 44A–44E, 68, 70, 72 and 74) are separable adjacent upper portions of the side support members.

11. The extensible and retractable canopy structure according to claim 1, wherein: lengths of the side support members (38A–38E, 40A–40E, 42A–42E, 44A–44E, 68, 70, 72 and 74) are adjustable; and wheels (100) are mounted on the lower portions of the side support members to facilitate the extension and retraction of the canopy structure.

12. The extensible and retractable canopy structure according to claim 1, including: means (104) at a second end of the canopy structure for securing one of the canopy end frames (58 or 60) to a structure; and the canopy end cover means (92) being at the first end of the canopy structure.

13. The extensible and retractable canopy structure according to claim 12, wherein: the canopy end cover means (92) comprises a series of overlapping, vertically extending, flexible strips (94 and 96) depending from the canopy support frame.

14. The extensible and retractable canopy structure according to claim 1, wherein: there are at least three extensible and retractable canopy support sections (24A–24E).

15. The extensible and retractable canopy structure according to claim 1, wherein: there are at least five extensible and retractable canopy support sections (24A–24E).

16. The extensible and retractable canopy structure according to claim 1, including: an outer moisture proof layer (98) overlaying the canopy cover and secured to the canopy structure.

* * * * *